US008427501B2

(12) United States Patent
Bardot

(10) Patent No.: US 8,427,501 B2
(45) Date of Patent: Apr. 23, 2013

(54) METHOD OF CALIBRATING A DISPLAY DEVICE BY ITERATION IN ORDER TO OPTIMIZE AN ELECTRICAL CONTROL VOLTAGE OF THE DISPLAY DEVICE

(75) Inventor: Christophe Bardot, Andredy (FR)

(73) Assignee: Johnson Controls Technology Company, Holland, MI (US)

( * ) Notice: Subject to any disclaimer, the term of this patent is extended or adjusted under 35 U.S.C. 154(b) by 579 days.

(21) Appl. No.: 12/618,279

(22) Filed: Nov. 13, 2009

(65) Prior Publication Data

US 2010/0123712 A1 May 20, 2010

(30) Foreign Application Priority Data

Nov. 14, 2008 (FR) ..... 08 06350

(51) Int. Cl.
*G09G 3/30* (2006.01)

(52) U.S. Cl.
USPC ..... 345/617; 382/274

(58) Field of Classification Search ..... None
See application file for complete search history.

(56) References Cited

U.S. PATENT DOCUMENTS

| | | | | |
|---|---|---|---|---|
| 5,877,787 | A | 3/1999 | Edge | |
| 6,414,664 | B1 | 7/2002 | Conover et al. | |
| 7,312,779 | B1 | 12/2007 | Blevins | |
| 2002/0054010 | A1 | 5/2002 | Lowles et al. | |
| 2007/0242153 | A1 * | 10/2007 | Tang et al. | 348/365 |
| 2007/0247404 | A1 | 10/2007 | Yoshimura | |

FOREIGN PATENT DOCUMENTS

| | | | |
|---|---|---|---|
| DE | 10239619 | A1 | 3/2004 |
| DE | 102007019318 | A1 | 10/2007 |
| EP | 1 117 088 | A | 7/2001 |
| WO | WO-2004/093042 | A | 10/2004 |

OTHER PUBLICATIONS

French Search Report and Written Opinion as received in corresponding French Application No. FR 08/06350, 7 pages, Oct. 26, 2011.

* cited by examiner

*Primary Examiner* — Joseph Haley
(74) *Attorney, Agent, or Firm* — Foley & Lardner LLP

(57) ABSTRACT

The present invention relates to a method of calibration of a display device by iteration in order to optimize an electrical control voltage of the display device, the calibration method comprising a measurement of an optical contrast of the display device and a calculation of an electrical control voltage value, the optical contrast measurement and the calculation of the electrical voltage value being carried out once during each calibration step, the optimization of the electrical control voltage being carried out starting from an initial value of the electrical control voltage and ending with a final value of the electrical control voltage, the calibration method being carried out by means of an initial calibration step and by means of a calibration refinement step, the initial calibration step being carried out once during the calibration method, the calibration refinement step being carried out once or several times during the calibration method, the approximation of the final value of the electrical control voltage due to the initial calibration step being higher than the approximation of the final value of the electrical control voltage due to the calibration refinement step.

6 Claims, 2 Drawing Sheets

METHOD OF CALIBRATING A DISPLAY DEVICE BY ITERATION IN ORDER TO OPTIMIZE AN ELECTRICAL CONTROL VOLTAGE OF THE DISPLAY DEVICE

The present invention relates to a method of optical calibration of a matrix display device and a display device.

Methods of optical calibration of display devices are known. Contrast compensation makes it possible to ensure optimum optical contrast over the whole range of temperatures which can occur. However, this curve is defined on reference specimens and a batch of display devices (LCD, that is to say liquid crystal display devices in particular) at a particular time. According to the specifications of the display devices supplied by the suppliers there is a spread which can only be compensated for by an offset value on the curve. This offset must be calibrated on a unit basis in the factory, that is to say a calibration is required for each display device.

A remedy proposed by the German patent application DE 10 2007 019 318 A1 consists in providing labels to stick on the display devices. From this document, optical contrast calibration for display devices which is carried out prior to selling the display device to a final customer, in particular prior to the fitting of the display device in a vehicle, is known.

A disadvantage of such devices, according to the prior art, is the fact that the way in which the final calibration of the optical contrast for such a device is proposed necessitates great effort, in particular the necessity of sticking a label on the display device and the necessity of reading the information printed on this label.

Another proposal for carrying out a calibration of display devices appears in the German patent application DE 102 39 619 A1. It is proposed to calibrate an optical contrast by carrying out a certain number of iterations whilst changing the value of the electrical control voltage using a fixed increment or decrement of the electrical control voltage.

A disadvantage of such devices, according to the prior art, consists in the fact that the number of iterations to be carried out in order to determine an optimum (or final) value of the electrical control voltage of the display device can be relatively high, which results in a longer time also being required in order to carry out the calibration of the display device.

An objective of the present invention is, in particular, to overcome the disadvantages of the prior art, and in particular those mentioned above, and its objective is also to propose an optical calibration method for a display device which is more reliable and faster and which succeeds for a greater proportion of the parts to be calibrated, that is to say which results in a low reject rate.

According to the present invention, this objective is achieved by a method of calibration of a display device by iteration in order to optimize an electrical control voltage of the display device, the calibration method comprising a measurement of an optical contrast of the display device and a calculation of an electrical control voltage value, the optical contrast measurement and the calculation of the electrical voltage value being carried out once during each calibration step, the optimization of the electrical control voltage being carried out starting from an initial value of the electrical control voltage and ending with a final value of the electrical control voltage, the calibration method being carried out by means of an initial calibration step and by means of a calibration refinement step, the initial calibration step being carried out once during the calibration method, the calibration refinement step being carried once or several times during the calibration method, the approximation of the final value of the electrical control voltage due to the initial calibration step being higher than the approximation of the final value of the electrical control voltage due to the calibration refinement step.

By such an embodiment of the method of calibration of a display device it is advantageously possible to minimize the number of iterations necessary in order to have a very good calibration of the display device. It follows that the cost price of producing such display devices can be reduced and the number of parts produced or calibrated per unit time can be increased.

A particularly preferred improvement of the invention is the fact that the calculation of the electrical control voltage of the display device is carried out digitally.

By such an embodiment of the method of calibration of a display device, it is advantageously possible to carry out the calculation of a value of the electrical control voltage in the simplest possible way, which results in a reduced cost price for producing such display devices.

Another preferred improvement of the invention is the fact that the measurement of an optical contrast of the display device is based on a measurement of the luminance of different parts of the display device, in particular on the measurement of the luminance of four parts of the display device.

A particularly preferred improvement of the invention is the fact that the parts taken into account for the measurement of the optical contrast of the display device form an image of the test pattern type.

Another preferred improvement of the invention is the fact that during the initial calibration step, the calculation of the electrical control voltage value is based on a comparison with standard values.

A particularly preferred improvement of the invention is the fact that during the calibration refinement step, the calculation of the electrical control voltage value is based on the difference between the measured optical contrast and a final optical contrast.

Another preferred improvement of the invention is the fact that the optical contrast measurements of the display device during the initial calibration step and during the calibration refinement step take into account a prior measurement of the homogeneity of a backlighting of the display device.

Other features and advantages of the invention will become apparent on reading the following description of a particular and non-limiting embodiment of the present invention.

BRIEF DESCRIPTION OF THE DRAWINGS

The invention will be better understood by means of the following description, which refers to preferred embodiments, given by way of non-limiting examples and explained with reference to the appended drawings in which.

DESCRIPTION OF THE DRAWINGS

Figure 1:
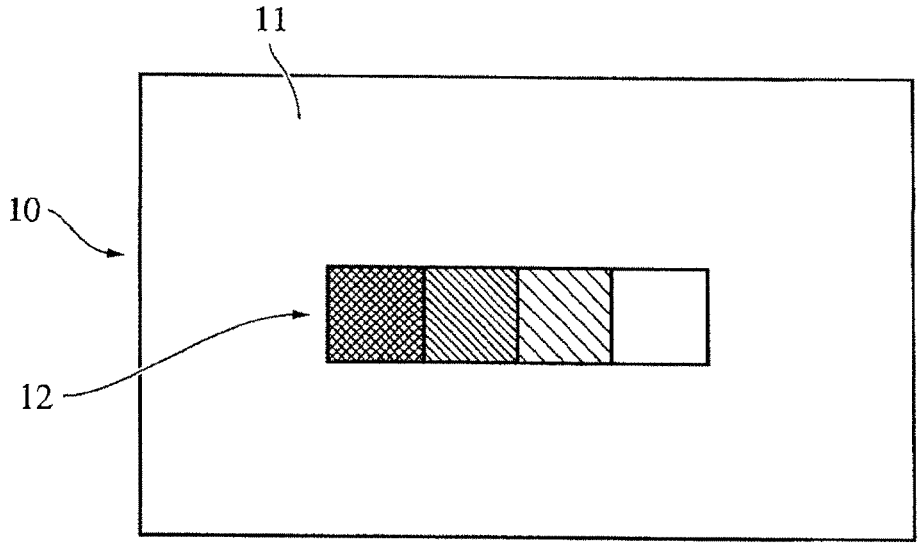
FIG. 1 is a diagrammatic front view of a display device which can be calibrated by means of the calibration method according to the present invention.

As shown in FIG. 1 of the appended drawing, a display device 10 comprises a display surface 11. FIG. 1 of the drawing shows the display device 10 as a user of the display device 10 sees it, in particular the driver of the vehicle in which the display device 10 is fitted.

Figure 2:
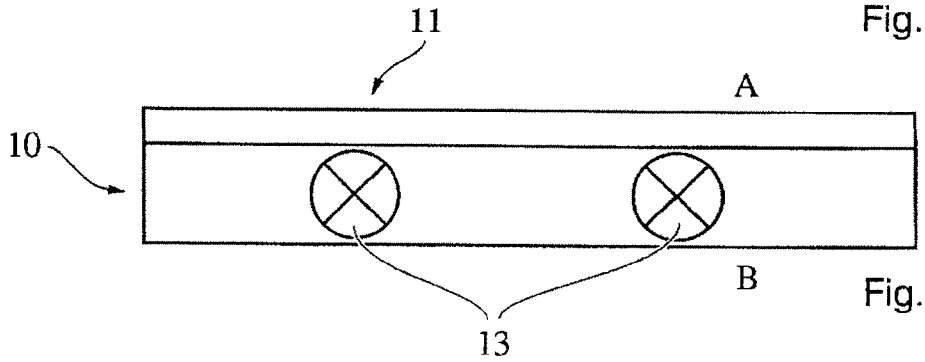
FIG. 2 is a diagrammatic cross-sectional view of the display device.

FIG. 2 shows a diagrammatic cross-sectional view of the display device 10. In this representation, the front face A of the display surface 11 is the face which is visible to a user, in particular to the driver of the vehicle in which the display device 10 is fitted. The rear face B of the display surface 11 can comprise backlighting 13.

The invention relates in particular to a calibration method for a liquid crystal display, that is to say to LCD (liquid crystal display) devices. The display device 10 controls the transmission of light through liquid crystal cells as a function of video signals which are applied to it in such a way as to display an image.

In order to result in this image having sufficient contrast, an electrical control voltage must be applied to the display device 10. The application of the correct electrical control voltage (or optimum electrical voltage) ensures an optical contrast of the display device which is close to the optimum value.

In order to measure the value of the optical contrast, in particular a part of the display surface 11 is taken into account according to the present invention. This part of the display surface 11 comprises a test pattern image 12. This test pattern image displays a certain number of parts which represent different gray levels and/or color levels, for example (from left to right in the example of the test pattern image shown in FIG. 1): a black part (will all of the pixels off), a gray part 2, a gray part 1 and a white part (with all of the pixels on).

The luminance of these different gray levels and/or color levels is measured using a camera (not shown in the drawing) during the measurement of the optical contrast. The value of the optical contrast is then calculated using the values of luminance measured in the different parts of the test pattern image 12. In the context of the present invention, the expression "measurement of an optical contrast of the display device" refers to the measurement of the luminance of these different gray and/or color levels and also to the calculation of the optical contrast. The optical contrast (CO), also called the optical ratio, is defined for example as follows:

$$CO = \frac{\text{Luminance of the white part} - \text{luminance of the black part}}{\text{Luminance of the gray part 1} - \text{luminance of the black part}}$$

The measurement is performed on the most luminous squares in order not to be disturbed by the background noise and also in order to reduce the acquisition time of the camera. Temperature influences the properties of the display device and thus the luminance value. This is caused in particular by a problem of thermal non-homogeneity between the board of the display device (PCB, printed circuit board) on the one hand and the display device itself on the other hand due to heat welding. Consequently, it is necessary to define a temperature threshold beyond which the specimen cannot be calibrated. For the other situations, as the calibration time is short (having an order of magnitude of less than 60 seconds), the influence of temperature variation is negligible.

The optimum or accepted optical contrast limits (or optical ratio) are defined by standard specimens (display devices 10). The specimens (display devices 10) have an approved optical contrast value and thus make it possible to adjust the calibration benches. However during the manufacture of the display devices 10, it is inevitable to have a certain degree of spread in the exact values of control voltage of the display device 10 in order to obtain a certain optical contrast level.

Figure 3:
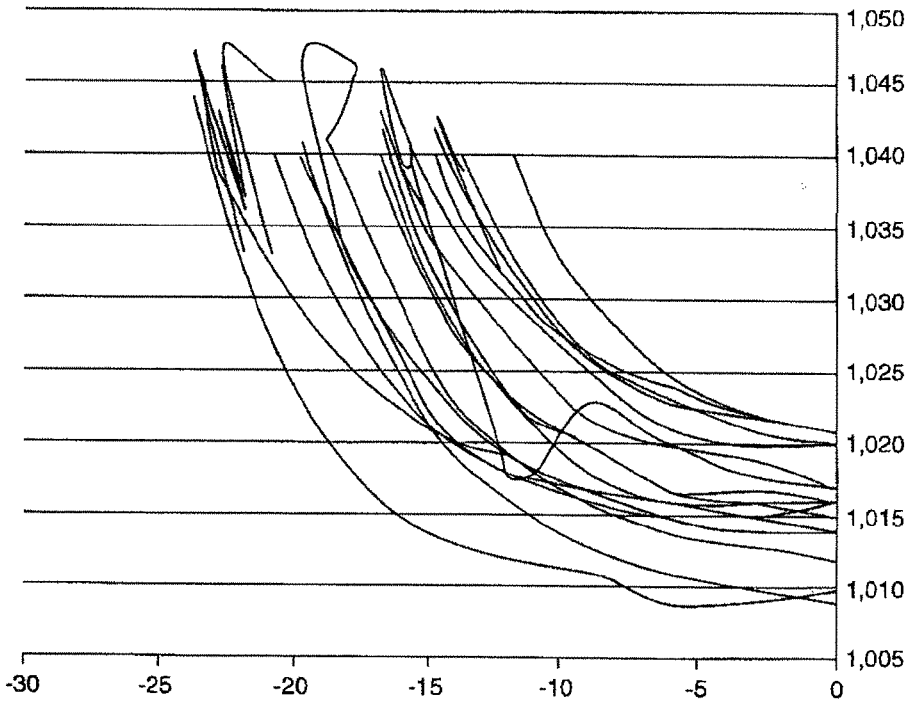
FIG. 3 is a diagrammatic view which shows different curves of the optical ratio (that is to say the contrast) as a function of the electrical control voltage (expressed in offset values with respect to a reference voltage)

FIG. 3 is a diagrammatic view of a diagram which shows different curves of the optical ratio (that is to say of the optical contrast) as a function of the electrical control voltage (expressed in offset values with respect to a reference voltage). The offset values are expressed in numerical units.

Figure 4:
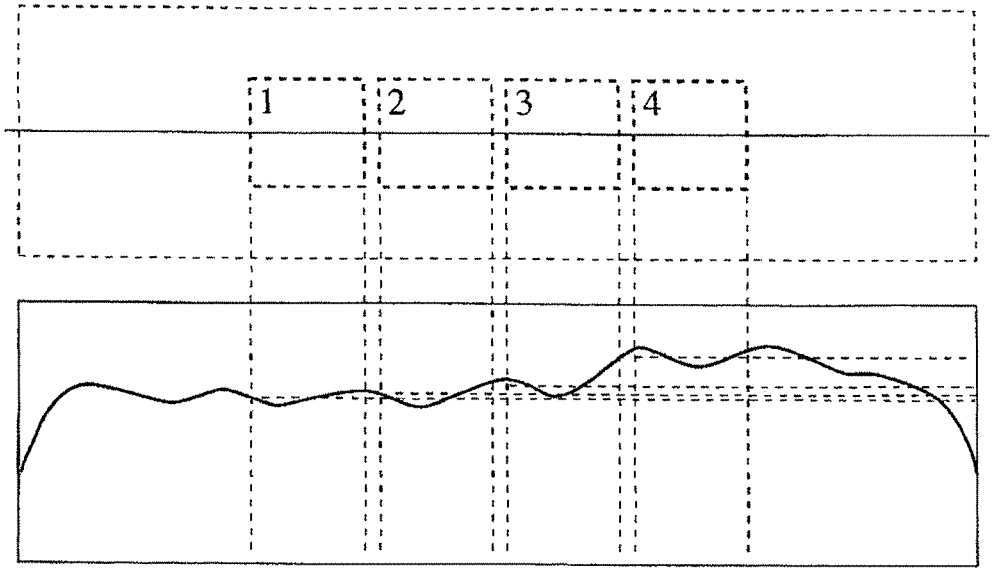
FIG. 4 is a diagrammatic view to illustrate the repercussion of a reduced homogeneity of the backlighting of the display device.

FIG. 4 is a diagrammatic view to illustrate the repercussion of a reduced homogeneity of the backlighting 13 of the display device 10. The top of FIG. 4 shows the part of the display surface 11 with the test pattern image when all of the parts of the test pattern image have an identical transmission (of the display device), that is to say, for example, all of the parts are white or black. The non-homogeneity shown directly represents the characteristics of the backlighting. Preferably, the calibration method according to the present invention uses measurements of luminance over separated zones of the display surface 11. The perceived luminance is then dependent on the homogeneity of the backlighting. With a prior measurement of the luminance of such identical parts, it is possible to normalize the values of the luminance measured subsequently in the different parts of the test pattern image (during the initial calibration step and during the calibration refinement step(s)).

The calibration method according to the present invention uses measurements on the test pattern image, for example as shown in FIG. 1, with different gray levels. These gray levels are displayed on adjacent surfaces (four of them in this example) having equivalent areas.

The calibration method according to the present invention comprises an initial calibration step which is carried out once during the calibration method. The initial calibration step comprises the sub-step of measurement of the optical contrast with an electrical control voltage of the display device 10 corresponding to the nominal control voltage, that is to say with an offset of 0. Moreover, the initial calibration step comprises the sub-step of calculating a new value of the electrical control voltage which is to be used in the following refinement step. Preferably, the calculation of the value of the electrical control voltage is based on a comparison with standard values taken for example by examining a certain number of display device specimens and calculating averages over such a standard set with regard to an initial value of the optical contrast, an initial value of the control voltage (which can correspond to the nominal value of the control voltage, that is to say an offset of 0), a final value of the optical contrast and a final value of the control voltage.

The calculation of the (new) value of the control voltage (TDP) can then be carried out, for example, as follows ("CO" being the optical contrast):

$$TDP_{new} = TDP_{final} * \frac{CO_{measured} - CO_{final}}{CO_{initial} - CO_{final}}$$

For example, if the standard information indicates

- that the (initial) value of the optical contrast is 1.016 for the nominal value of the control voltage (that is to say for an offset of 0), which corresponds to an initial value of the control voltage and
- that the (final or desired) value of the optical contrast is 1.029 for a value of the control voltage having an offset of −14, which corresponds to a final value of the control voltage, a measured optical contrast value of 1.021 results in a new value of the control voltage corresponding to an offset value of −9. The calibration refinement stage is started using this new value of the control voltage.

The calibration method according to the present invention comprises a calibration refinement step which is carried out once or several times during the calibration method. The calibration refinement step comprises the sub-step of a measurement of the optical contrast with an electrical control voltage corresponding to the new voltage obtained in the initial calibration step. Moreover, the calibration refinement step comprises the sub-step of calculating a subsequent value of the electrical control voltage which is to be used (if needed) in a following subsequent refinement step. Preferably, the calculation of the subsequent value of the control voltage (TDP) is carried out as follows starting from a preceding value of the control voltage (TDP) which corresponds either to the (new) value resulting from the calculation sub-step of the initial step (for the first refinement step) or to the (subsequent) value resulting from the calculation sub-step of the preceding refinement step (for the subsequent refinement steps):

$$TDP_{subsequent}=TDP_{preceding}+\text{Round}[(CO_{final}-CO_{measured})*G]$$

"CO" being the optical contrast and "G" being a constant defining the amount of the variation of the control voltage with a given difference between $CO_{final}$ and $CO_{measured}$. The value of "G" is for example fixed at 500.

The iteration is carried out (that is to say the refinement step is repeated) until a stop criterion is met, in particular the fact that $CO_{measured}$ is equal to or almost equal to $CO_{final}$ or that a maximum number of iteration loops has been reached. The value of the control voltage resulting from the last iteration of the refinement step is called the final value of the control voltage.

With a sample of 46 display device 10 specimens, it was possible to complete the calibration method with an average of three iterations. In all cases the approximation of the final value of the electrical control voltage due to the initial calibration step was higher than the approximation of the final value of the electrical control voltage due to the calibration refinement step(s).

The invention claimed is:

1. A method of calibration of a display device by iteration to optimize an electrical control voltage of the display device, the calibration method comprising:

iteratively measuring an optical contrast of the display device and calculating an electrical control voltage value, wherein the measurement of the optical contrast and the calculation of the electrical control voltage value are carried out once during each iteration, wherein the optimization of the electrical control voltage is carried out starting from an initial value of the electrical control voltage and ending with a final value of the electrical control voltage, wherein the iterations include an initial calibration step carried out once and comprising calculating a new value ($TDP_{new}$) of the electrical control voltage starting from an initial standard value ($CO_{initial}$) of the optical contrast and a final standard value ($CO_{final}$) of the optical contrast, from a measured value ($CO_{measured}$) of the optical contrast, and from a final value ($TDP_{final}$) of the control voltage according to:

$$TDP_{new}=TDP_{final}*([CO_{measured}-CO_{final}]/[CO_{initial}-CO_{final}]),$$

wherein the iterations include at least one calibration refinement step, the calibration refinement step comprising calculating at least one of a subsequent value ($TDP_{subsequent}$) of the electrical control voltage starting from a preceding value ($TDP_{preceding}$) of the electrical control voltage, from the measured value of the optical contrast, and from a standard final value of the topical contrast and by using a constant (G) according to:

$$TDP_{subsequent}=TDP_{preceding}+\text{round}([CO_{final}-CO_{measured}]*G),$$

an approximation of the final value of the electrical control voltage due to the initial calibration step being higher than the approximation of the final value of the electrical control voltage due to the calibration refinement step.

2. The calibration method as claimed in claim 1, wherein the calculation of the electrical control voltage of the display device is carried out digitally.

3. The calibration method as claimed in claim 1, wherein the measurement of the optical contrast of the display device is based on a measurement of a luminance of different parts of the display device.

4. The calibration method as claimed in claim 1, wherein the parts taken into account for the measurement of the optical contrast of the display device form an image of a test pattern type.

5. The calibration method as claimed in claim 1, wherein, during the calibration refinement step, the calculation of the electrical control voltage value is based on the difference between the measurement of the optical contrast and a final optical contrast.

6. The calibration method as claimed in claim 1, wherein the measurement of the optical contrast of the display device during the initial calibration step and the measurement of the optical contrast during the calibration refinement step take into account a prior measurement of the homogeneity of a backlighting of the display device.

* * * * *